United States Patent [19]

Box et al.

[11] Patent Number: 4,842,025

[45] Date of Patent: Jun. 27, 1989

[54] WIRE TWISTING TOOL

[75] Inventors: Joe G. Box, Macedonia; J. E. C. Anderson, Moreland Hills, both of Ohio

[73] Assignee: Milbar Corporation, Chagrin Falls, Ohio

[21] Appl. No.: 927,098

[22] Filed: Nov. 5, 1986

Related U.S. Application Data

[63] Continuation-in-part of Ser. No. 820,540, Jan. 17, 1986, abandoned.

[51] Int. Cl.[4] ..... B21F 7/00

[52] U.S. Cl. ..... 140/119; 7/127

[58] Field of Search ..... 81/488; 140/121, 119, 140/149; 7/129, 130

[56] References Cited

U.S. PATENT DOCUMENTS

| | | |
|---|---|---|
| 852,479 | 5/1907 | Weiss . |
| 978,028 | 12/1910 | Kaspar . |
| 1,027,097 | 5/1912 | Beam . |
| 1,136,220 | 4/1915 | Fegley . |
| 1,740,392 | 12/1929 | Donaldson . |
| 2,032,415 | 3/1936 | Hirsch . |
| 2,394,807 | 2/1946 | Robinson . |
| 2,416,002 | 2/1947 | Greer et al. . |
| 2,655,953 | 10/1953 | Miloche . |
| 2,737,983 | 3/1956 | Pray . |
| 2,964,069 | 12/1960 | Chappel et al. . |
| 3,092,152 | 6/1963 | Neff . |
| 3,420,280 | 1/1969 | Allyn . |

*Primary Examiner*—Roscoe V. Parker

*Attorney, Agent, or Firm*—Watts, Hoffmann, Fisher & Heinke

[57] ABSTRACT

A wire twisting tool that includes a pair of jaws for clamping wire ends to be twisted and a removable spin drive unit for imparting rotation to the jaws to effect twisting of the wire ends. The spin drive unit is threadedly attached to a housing that encloses a spiral drive shaft. A pair of shaft engaging elements is mounted in a spaced apart relationship within a tubular carrier that forms part of the spin drive unit. The one end of the carrier is threaded and threadedly engages the housing. One of the shaft engaging elements is fixed to the carrier so that as the shaft is pulled through the drive element, rotation is imparted to the carrier. The other element slidably supports the drive shaft in order to maintain it in a predetermined alignment with respect to the carrier. In one embodiment, the support element is fixed to the carrier whereas in another embodiment it is free to move within the carrier to accommodate a change in pitch in the spiral shaft. In still another embodiment, the support element is attached to one end of the spiral shaft and is slidable within the housing. The shaft engaging elements can be formed from metal stamping to provide a relatively inexpensive construction and a construction in which the primary wear components can be easily replaced or removed for sterilization.

26 Claims, 3 Drawing Sheets

WIRE TWISTING TOOL

CROSS REFERENCE

The present application is a continuation-in-part of U.S. Ser. No. 820,540, filed Jan. 17, 1986.

TECHNICAL FIELD

The present invention relates generally to hand tools and in particular to a new and improved wire twisting tool.

BACKGROUND OF INVENTION

In many applications, fasteners used to secure an assemblage of components, must be locked to prevent inadvertent loosening or separation. For example, in the aircraft industry, bolts used to hold critical components are fixed with a locking wire to prevent loosening due to vibration or other factors. For many military products, the Government requires the use of locking wires for the same reason.

In a typical application, each fastener includes an aperture for receiving the locking wire. After the fastener or group of fasteners is installed, the wire is passed through the aperture of one or more fasteners and the ends of the wire are twisted to secure it into position. In many cases, the twisting must be carried out in a careful manner to insure that the wire is not unduly stressed but yet is tightly installed so that loosening of the fastener is inhibited.

To facilitate the installation of locking wire, various tools have been proposed. One such tool comprises a pair of movable jaws, a means for locking the jaws in a closed or clamped position and a drive mechanism for rotating the jaws to effect the twisting of the wire ends. In a commonly available version of this tool, the tool is plier-like in construction and includes jaws that are opened and closed by the operator by means of handles. The drive mechanism is carried by at least one of the handles and includes a housing that rigidly mounts a nut-like element. The nut-like element is designed to engage a twisted rod mounted for reciprocating movement within the housing. An operating knob is operatively connected to one end of the shaft. In use, the operator clamps the wire to be twisted between the jaws. A jaw locking mechanism is engaged to maintain the clamped position of the jaws. The operating knob connected to the end of the shaft is then pulled by the operator. As the shaft passes through the drive nut, rotation is imparted to the housing which causes the entire tool including the jaws to rotate about an axis defined by the twisted rod. This rotation rotates the jaws a predetermined number of turns to effect twisting of the wire. After the wire has been twisted, the jaws are released to unclamp the wire ends.

It has been found that the drive mechanism bears the brunt of the wear in the tool. Although the twisted rod and/or the nut element is replaceable in some tools, it has been found that replacement is not easily effected and/or the construction is prohibitively expensive.

The use of locking wire is not limited to aircraft and/or military applications. The medical profession, specifically orthopedics, uses wire in the setting of bones or the like. As a result, a wire twisting tool suitable for the surgical environment is desirable. In order to satisfy this need, the tool must lend itself to sterilization. It is believed that prior wire twisting tools were difficult or impossible to completely sterilize and hence were unacceptable for use by medical professionals.

DISCLOSURE OF INVENTION

The present invention provides a new and improved wire twisting tool which includes a replaceable drive mechanism which is both easily removed when necessary and is relatively inexpensive.

In the preferred embodiment, the wire twisting tool includes a pair of pivotally connected, plier-like members. Each member includes a jaw portion and a handle portion arranged such that when the handles are squeezed, the jaws are moved toward each other. A latching mechanism is provided to lock the handles in a squeezed position and thereby provide a means for maintaining engagement of the wire to be twisted, between the jaws.

The tool includes a drive unit which is actuated by the operator to rotate the jaws to effect the wire twisting operation. The drive unit includes a spiral shaft having an axis of rotation which preferably parallels a longitudinal dimension of the tool and which intersects the pivot for the tool members in a plane defined by the clamped jaws. An external end of the shaft mounts a knob by which an operator pulls the shaft out of the housing. When the shaft is pulled by the operator, rotation is imparted to the plier-like portion of the tool to effect wire twisting.

In the preferred and illustrated embodiment, the spiral shaft, when not in use, is located within a housing carried by at least one of the handle portions. In accordance with the preferred embodiment, the spiral shaft forms part of the drive unit which is removably mounted to the housing. In accordance with this embodiment, the drive unit includes structure operatively engageable with the spiral shaft.

With the preferred construction, when the drive mechanism becomes worn after repeated use, the drive unit which includes the components that are subject to wear is simply replaced and the rest of the tool is retained.

According to the invention, the replaceable drive unit includes a carrier, removably secured to the housing, a drive element fixed relative to the housing and operatively engageable with the spiral shaft and a support element normally spaced from the drive element that supports another portion of the spiral shaft.

The drive element imparts rotation to the housing as the spiral shaft, which is prevented from rotating, is pulled through the element. The support element supports the spiral shaft to maintain its alignment within the housing.

In one embodiment of the invention, both the drive element and the support element are fixed within the carrier. In accordance with this embodiment, the elements are preferably stamped parts that each define a central aperture shaped to be similar to the cross-section of the spiral shaft. As should be appreciated, as the shaft is pulled through the apertures in the elements, rotation is imparted to the carrier if the shaft itself is prevented from rotating.

In the preferred embodiment, the drive element is pressed into the carrier. An interference fit is established between the carrier and the element to inhibit their separation. To further inhibit relative rotation between the carrier and the drive element, the element is formed with a pair of ears or tab-like structures which are engageable with complementally formed structures or slots on the inside of the carrier.

According to a second embodiment of the invention, the support element is rotatably carried by the carrier and is allowed to rotate relative to the carrier as the shaft is pulled through its aperture. With this construction, the need for critical placement of the drive and support elements is obviated and the assembly of the drive mechanism is thus simplified.

In accordance with a feature of the second embodiment, the spiral shaft is formed with a varying pitch. In the preferred embodiment of this feature, the knob end of the shaft is formed with a longer pitch so that as the shaft is initially pulled by the operator, an apparent torque multiplication is achieved since fewer turns are imparted to the jaws for a given extension of the shaft. The pitch of the spiral shaft increases after a predetermined extension. This feature improves the operation of the tool because in normal operation, a greater pulling force must be applied by the operator to begin the initial twisting of the wires. Once the twisting is started, less force is required to finish the twisting operation. With the disclosed construction, the use of a longer pitch at the beginning of the shaft travel, reduces the force that must be applied by the operator in order to start the twisting operation. Once started, however, a finer pitch is provided so that the requisite number of jaw rotations are achieved by the time the shaft is fully extended.

The use of a support element, rotatably mounted within the carrier, enables the use of a discontinuous spiral on the shaft. As the pitch of the spiral changes, the support element rotates to accommodate the pitch modification.

According to another embodiment, the spiral shaft carrier includes a pair of drive and support elements that are spaced apart by a torsion and/or compression spring. The support element is rotatably supported by the carrier. When a torsion spring is used, the spring is connected and applies a rotating force, to the support element and tends to rotate the element about an axis coincident with the axis of the spiral shaft. In accordance with this embodiment, after the shaft is installed in the carrier, and is coengaged by both the fixed drive element and the rotatable support element, the force applied by the spring to the support element tending to rotate it, causes a drag force to be applied to the spiral shaft and prevents it from falling from the tool housing of its own weight, when the tool is held upright.

When a compression spring is used, the support element is allowed to move axially against the spring in response to changes in pitch along the shaft. The spring acts between the fixed element and the support element and maintains a minimum separation between these elements. As the pitch of the spiral shaft changes, the support element moves axially to accommodate the changes in pitch. If a combination torsional and compression spring is used, the support element may move axially, rotate, or both to accommodate changes in shaft pitch.

According to still another embodiment of the invention, the support element for maintaining alignment of the spiral shaft within the housing, is mounted near one end of the spiral shaft. In this embodiment, the support element forms a part of the spiral shaft and slides along the inside of the housing when the spiral shaft is pulled by the operator. In this embodiment, the spiral shaft can be pulled out of the housing until the support element attached near the end of the spiral shaft abuts the fixed drive element forming part of the carrier (which as described above, imparts rotation to the spiral shaft). The added travel of the spiral shaft permitted by this construction imparts additional revolutions to the wire twister so that for the same size spiral shaft, more rotations of the wire twister are realized.

With the disclosed construction, a wire twisting tool is provided that includes a replaceable but inexpensive spin drive unit. The actual drive elements can be formed from stamped steel parts that are easily and effectively installed into a carrier which in turn is threadedly received by the tool housing. Replacement of the drive unit can be completed quickly and efficiently by the operator.

In addition, since the drive unit is easily removable, the tool can be completely sterilized. As a consequence, the disclosed tool can be used in a surgical environment.

Additional features of the invention will become apparent and a fuller understanding obtained by reading the following detailed description made in connection with the accompanying of drawings.

BEST MODE FOR CARRYING OUT INVENTION

Figure 1:
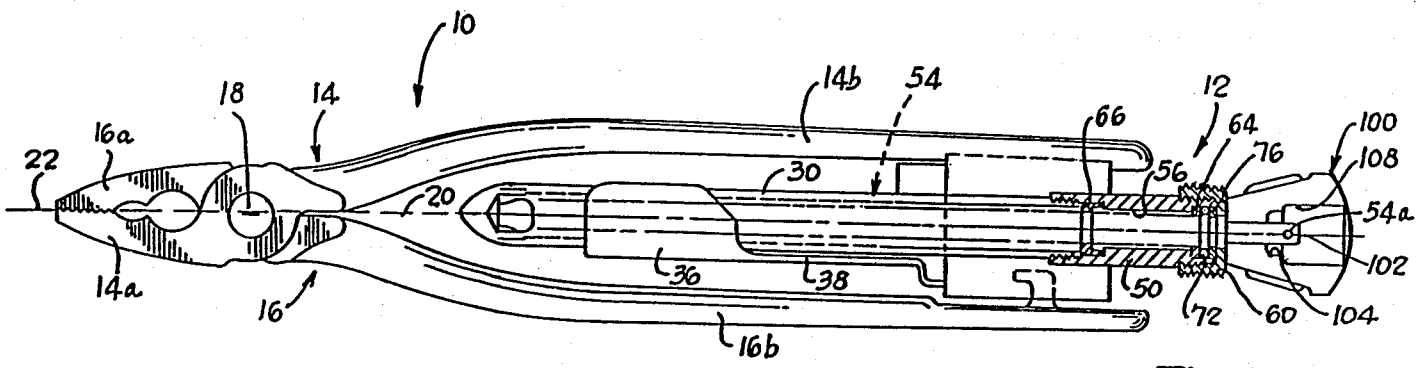
FIG. 1 is a side elevational view of a wire twisting tool constructed in accordance with a preferred embodiment of the invention.

FIG. 1 illustrates the overall construction of a wire twisting tool embodying the present invention. In the illustrated embodiment, the tool comprises a plier-like portion indicated generally by the reference character 10 and a drive section indicated generally by the reference character 12. The plier-like portion includes a pair of pivotally connected members 14, 16, the member 14 including a jaw **14*a* and a handle 14*b* and the member 16 including a similarly formed jaw 16*a* and handle 16*b*. The handle members are interconnected by a pivot 18. It should be apparent that, as the handles 14*b*, 16*b* are separated, the jaws 14*a*, 16*a*** move apart. When the handles are squeezed, the jaws move together into a clamping relationship.

As is conventional, wire ends (not shown) to be twisted are clamped between the jaws **14*a*, 16*a* and once clamped, the spin drive unit 12 is actuated by the operator to rotate the plier-like portion 10 about an axis 20 to effect twisting of the wire ends. As seen in FIG. 1, the axis 20 substantially intersects the axis of the pivot 18 and a clamping plane 22 formed between the jaws 14*a*, 14*b***.

Figure 2:
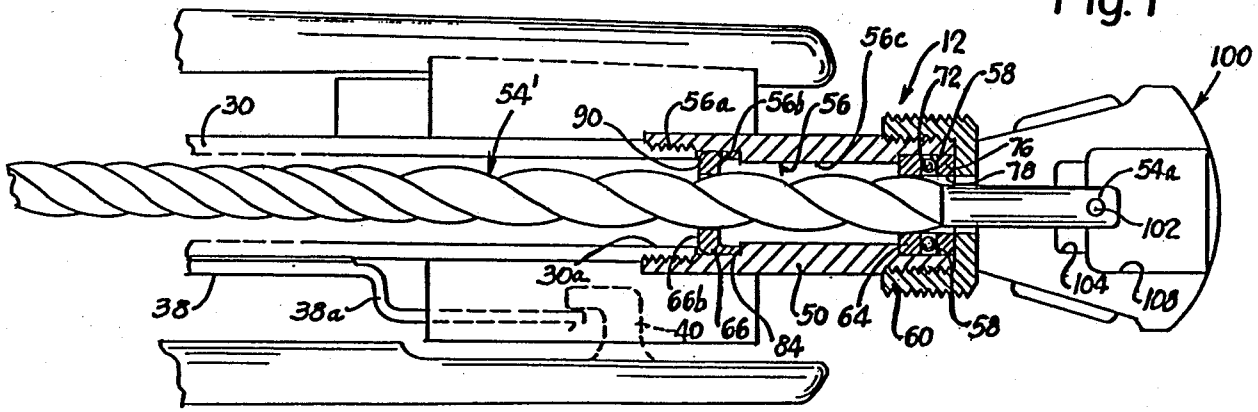
FIG. 2 is an enlarged, fragmentary view, partially in section, of the tool shown in FIG. 1.

Referring also to FIG. 2, a tubular housing 30 is located between the handles 14*b*, 16*b* by support plates 32 (only one is shown in FIG. 1) that are welded to the handle 14*b*. A part of a handle latching mechanism is slidably carried on the outside of the housing 30 and includes an actuation plate 36 formed at one end of a latching arm 38. An outward end 38*a* of the latching arm 38 is engageable with a hook-like device 40 forming part of and located near the end of the handle 16*b*. As should be apparent, when the latch arm 38a is held beneath the hook 40, as is shown in FIG. 2, the jaws 14*a*, 16*a* are maintained in their clamped position, thus maintaining a clamping engagement with the wire ends to be twisted. To release the wire, the handles 14*b*, 16*b* are slightly squeezed to unload the extension arm 38*a*, allowing the extension arm to be moved from beneath the hook 40, thus releasing the handle 16*b*. The latch mechanism may be spring loaded to facilitate the use of the tool so that the extension arm 38 automatically disengages the hook 40 when the handles 14*b*, 16*b* are squeezed.

The spin drive unit 12 comprises an assembly that is removably mounted to one end of the housing 30. The drive assembly 12 includes a tubular carrier 50 that supports a spiral drive shaft 54 for reciprocating and relative rotational movement. The carrier 50 defines a throughbore 56. The left end of the throughbore 56 (as viewed in FIG. 2) includes an internally threaded end portion 56*a* and a stepped portion 56*b*. The right end of the bore 56 as viewed in FIG. 2 includes a pair of slots 58 spaced 180° apart. A uniform diameter bore portion 56*c* extends from the stepped portion 56*b* to the right end of the bore 56. The right end of the carrier 50 is externally threaded and is adapted to receive a knurled end cap 60. The internally threaded end portion 56*a* of the carrier 50 is adapted to receive a threaded end portion 30*a* of the tubular housing 30. With this construction, the entire carrier assembly 50 including the spiral shaft 54 is easily removed from the tool by simply unscrewing the carrier 50 from the end of the housing 30.

Figure 5:
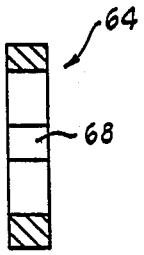
FIG. 5 is a cross-sectional view of a drive element forming part of the invention.
Figure 6:
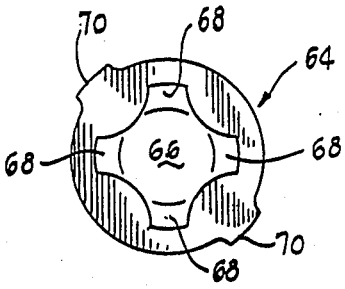
FIG. 6 is an elevational view of the drive element.

In the preferred embodiment, the spiral shaft 54 is supported centrally within the carrier 50 by a pair of spaced apart, washer-like elements 64, 66. Referring also to FIGS. 5 and 6, the element 64 is preferably a metal stamping and is locked to the carrier 50 to prevent relative rotative movement. Alternately the element 64 may be a molded part and may be formed from a plastic material. By locking the element 64 to the carrier 50, the element 64 forms a drive element.

As seen best in FIG. 6, the drive element 64 is circular in cross-section and defines an aperture 68 including four equally spaced radially extending slots 68*a*, extending from a central opening. The shape of the aperture 68 corresponds to a cross-section of the shaft 54. When the spiral shaft 54 is pulled through the aperture 68, rotational movement is imparted to the drive element 64 if the shaft itself is prevented from rotating.

To facilitate locking of the drive element 64 to the carrier 50, the drive element 64 includes a pair of tabs or ears 70, spaced 180° apart. The tabs 70 are shaped to fit within the slots 58 formed in the right end of the carrier 50. In the preferred embodiment, the overall dimension of the element 64 is sized to provide an interference fit with the inside of the end of the bore 56 so that once the element 64 is fully pressed into the right end of the carrier 50, it will be maintained in the position illustrated in FIG. 2. Alternately, the element may be loosely fitted into the slots 58 and bore 56 and be suitably clamped in position by the end cap 60.

In the illustrated embodiment, a felt washer 72 and plastic washer 76 are provided between the drive element 64 and the end cap 60. The felt washer 72 is normally saturated with a suitable lubricant and provides a source of lubrication for the spiral shaft 54 during use. The plastic washer 76 includes an aperture 78 that is sized to provide a slight interference fit with respect to the periphery of the spiral shaft 54. This slight interference fit applies a drag force to the drive shaft 54 and prevents it from falling out of the carrier 50 under its own weight when the tool is held upright. For applications that require sterilization of the drive unit, the felt washer 72 and/or the plastic washer 76 are omitted when these elements are unable to withstand the sterilization process to be used.

Figure 3:
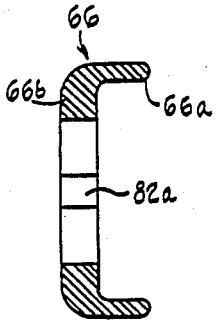
FIG. 3 is a cross-sectional view of a support element forming part of the invention.
Figure 4:
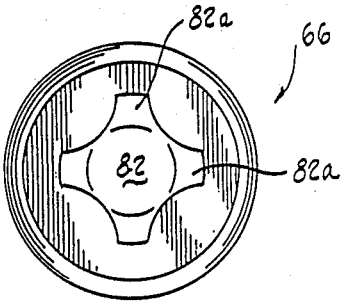
FIG. 4 is an elevational view of the support element.

Referring also to FIGS. 3 and 4, the support element 66 is cup-shaped and defines an aperture 82 which is similar to the aperture 68 formed in the drive element 64 and includes radially extending slots 82*a*. In the preferred embodiment, the element 66 provides a support function so that the spiral shaft 54 is supported centrally within the carrier 50 and hence the housing 30. In one embodiment of the invention, the spiral shaft includes a fixed pitch and in this embodiment, the support element 66 is preferably press fitted into the stepped portion 56*b* of the throughbore 56. In particular, the element is pressed into the bore until an axially extending rim 66*a* abuts a shoulder 84 formed between the stepped portion 56*b* and the uniform diameter bore portion 56*c*.

The extension and retraction of the spiral shaft 54 relative to the housing 30 and carrier 50 is accomplished by the operator by means of an operating knob 100 which is attached to an external end 54*a* of the spiral shaft 54. As is conventional, a one-way clutch construction may be employed to facilitate operation. In particular, a cross pin 102 is mounted at the end of the shaft and is engageable with a cross slot 104 formed in the knob. When the knob 100 is pulled to the right as seen in FIG. 2, after an initial relative rotation of 90°, the cross pin 102 can enter the cross slot 104, thus locking the spiral shaft 54 to the knob 100. In normal operation, the operator grasps the knob 100 and releases the remainder of the tool so that as the spiral shaft 54 is pulled from the housing, the coaction between the shaft 54 and the drive element 64 imparts overall rotation to the tool and hence, the wire ends captured in the jaws 14*a*, 16*a*. As is also conventional, the rightmost end of the spiral shaft 54 includes an abutment or other structure such as a crimp to prevent it from passing through the carrier 50. When the abutment or crimp abuts the support element 66 further extension of the spiral shaft 54 is prevented.

The operator then re-grasps the overall tool and pushes the operating knob 100 towards the left (as viewed in FIG. 2). The initial push causes the knob to move relative to the end of the shaft 54*a* causing the cross pin 102 to leave the cross slot 104 and enter a large diameter recess 108 which provides clearance for the cross pin 102. Thus as the knob is pushed towards the tool, the spiral shaft 54 is allowed to rotate relative to the knob.

In an alternate embodiment of the wire twisting tool, a running clearance is provided between the support element 66 and the stepped portion 56*b*. The clearance enables the support element 66 to rotate relative to the carrier 50. In this embodiment, the axial position of the support element 66 within the stepped bore portion 56*b* is maintained by an end face 90 of the housing 30. To achieve this feature, the threaded end 30*a* of the housing is sized so that a slight clearance is provided between the end face 90 and a radial end face 66*b* of the element 66 when the carrier 50 is assembled onto the end of the housing 30, as shown in FIG. 2.

By allowing relative rotation between the support element 66 and the carrier 50, a variable pitch spiral shaft 54' can be accommodated. An example of a variable pitched spiral shaft is shown in FIG. 2. It should be noted that the change in pitch has been exaggerated in order to facilitate the explanation. In actual practice, the change in pitch would probably be more subtle.

With this construction, an extremely versatile and easily used tool is provided. It has been found that initial rotation of the tool to initiate twisting of the wire ends, requires a greater pulling force. By providing a longer pitch on the left end of the shaft 54', (as viewed in FIG. 2), as the shaft 54' is initially pulled through the carrier 50, less tool rotation for a given travel of the spiral shaft 54 is provided, thus decreasing the pulling force that must be applied by the operator to initiate rotation. After the twisting has begun, the pitch is decreased so that the revolutions of the tool increase for a given axial movement of the spiral shaft.

The change in pitch requires that either the relative axial positions of the drive and support elements 64, 66 change or alternately the relative rotative positions change. In the preferred embodiment, the changes in pitch are accommodated by the rotation of the support element 66 relative to the carrier 50.

Figure 7:
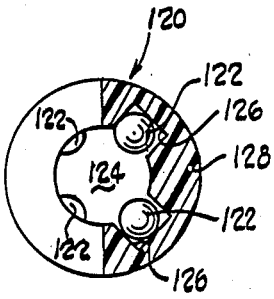
FIG. 7 is a view partly in section of a support element constructed in accordance with another embodiment of the invention.

Turning now to FIG. 7, an alternate construction for the drive element 64 and/or the support element 66 is illustrated. As seen in FIG. 7, the alternate element 120 includes a series of bearings 122 spaced equally about a through aperture 124. The bearings and aperture together define an opening that substantially corresponds to the cross-section of the spiral shaft 54. The bearings ride against the spiral shaft and provide improved wear characteristics for the drive unit 12. As seen in FIG. 7, the bearings are held within cavities 126 formed in a carrier 128. The carrier 128 can be formed with tabs such as the tabs or ears 70 formed on the drive element 64 shown in FIG. 6 and can also be formed with an axially extending rim such as the rim 66*a* formed on the support element 66 shown in FIG. 3.

Figure 8:
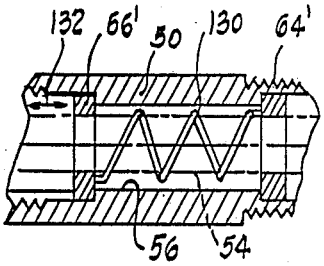
FIG. 8 is an elevational view, shown somewhat schematically, of alternate drive and support elements forming part of the present invention.

Turning now to FIG. 8, an alternate arrangement for mounting the drive and support elements is illustrated somewhat schematically. In this arrangement, drive and support elements 64', 66' are separated by a spring 130. In the preferred embodiment, the spring may be a compression, torsional or combination spring. As indicated above, in the construction shown in FIG. 2, a drag washer 76 is employed to prevent the spiral shaft 54 from falling from the housing 30 under its own weight. By using a torsional spring for the spring shown in FIG. 8, a rotational force tending to rotate the support element 66' relative to the drive element 64' causes a drag force to be applied to the spiral shaft. With this construction, the drag washer 76 can be eliminated. When used with a variable pitch spiral shaft 54', the spring 130 allows the support element 66' to rotate within the carrier 50, to accommodate the change in pitch.

In an alternate arrangement, a compression spring can be used to urge the drive and support elements apart. When used with a variable pitch spiral shaft 54' such as the one shown in FIG. 2, changes in pitch can be accommodated by axial movement in the support element 66' as indicated by the arrow 132. By using a combination compression and torsional spring, rotative and axial movement in the support element 66' can be accommodated.

In the preferred and illustrated embodiment as shown in FIGS. 1, 2, 5 and 6, the drive element 64 has been illustrated as including locking tabs 70 to facilitate the fixing of the drive element 64 within the carrier 50. The support element 66, on the other hand, is illustrated as including a cup-shaped rim 66*a*. It should be noted here that both elements can be virtually identical in construction. If both are constructed as cup-shaped elements, the periphery of the elements are sized and/or the dimensions of the inside of the bore 56 and the carrier 50 are sized to provide the necessary fit. For example, a cup-shaped drive element would be sized to provide a tight press fit in the right end (as viewed in FIG. 2) of the carrier 50 so that the element is inhibited from rotating relative to the carrier 50.

The support element 66 can also be formed without a rim depending on the application. In fact, with proper dimensioning, the support element 66 can be formed with tabs and be virtually identical to the construction of the drive element 64 shown in FIG. 6. This construction for the support element is suitable for applications that do not require relative rotation between the support element 66 and the carrier 50.

The present invention provides an improved wire twisting tool which is economical to manufacture and maintain. Unlike some prior art wire twisters, the entire tool does not have to be discarded should the drive mechanism fail or wear out. The drive unit 12 is simply unscrewed from the rest of the tool and replaced.

The drive unit itself eliminates the expensive nut constructions of the prior tools. By utilizing relatively simple metal stampings for the drive and support elements 64, 66, substantial cost reductions in the construction are realized without compromising reliability. The construction also lends itself to re-manufacture should that be desirable. In particular, a worn out drive unit 12 can be disassembled and the worn components replaced. Finally, the removable drive unit enables all the components of the tool to be sterilized and eliminates areas or regions that would otherwise trap dirt and other foreign matter. As a consequence, the disclosed tool has uses not only in the manufacturing industries but in the medical field as well.

Figure 9:
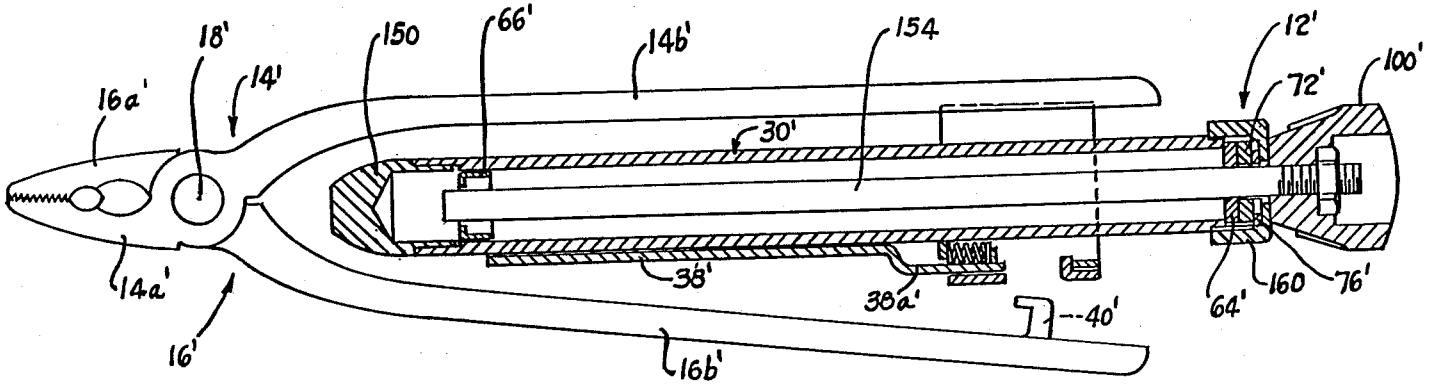
FIG. 9 is a side elevational view of a wire twisting tool constructed in accordance with another preferred embodiment of the invention.

Turning now to FIG. 9, another embodiment of the invention is illustrated. In order to facilitate the description of the wire twisting tool shown in FIG. 9, elements of the tool that are similar or the same as elements shown in FIG. 1 will be designated with like reference characters followed by an apostrophe (').

Like the tool shown in FIG. 1, the tool of FIG. 9 includes a pair of pivotally connected members 14', 6', the member 14' including a jaw 14*a'* and a handle 14*b'* and the member 16' including a similarly formed jaw 16*a'* and handle 16*b'*.

A tubular housing 30' is located between the handles 14*b'*, 16*b'* and mounts a spin drive unit 12' at its right end (as viewed in FIG. 9). The left end of the housing 30' mounts a nose piece 150 which encloses and substantially seals the left end opening of the housing 30'.

In the embodiment shown in FIG. 9, a spiral drive shaft 154 is mounted for reciprocating and relative rotational movement within the housing 30'. In the illustrated embodiment, a separate carrier (element 50 in FIG. 1) is not utilized. Instead, the drive unit 12' comprises a threaded end cap 160 that slidably carries the spiral drive shaft 154. A drive element 64' is securely clamped to the right end of the housing 30'. The drive element 64' is the same or similar to the drive element 64 shown in FIGS. 1–6. By locking the element 64' to the housing 30', rotation is imparted to the overall tool as the spiral shaft 154 is pulled from the housing 30' as is fully explained above.

Unlike the embodiment in FIG. 1, the support element 66' is not supported by a carrier. Instead, the support element 66' is attached to the left end of the spiral shaft 154 and slides along the inside of the housing 30' whenever the spiral drive shaft 154 is pulled. With the illustrated arrangement, the spiral shaft 154 can be pulled out of the housing 30' to a greater extent than it can in the embodiment shown in FIG. 1, for the same size tool. The extra extension is permitted since the support element 66' is not fixed within the carrier. The shaft 154 can be pulled from the housing until the element 66' abuts the drive element 64'. The extra extension permitted corresponds to the spacing between the drive element 64 and the support element 66 shown in FIG. 1. Thus for the same size tool, additional tool revolutions are provided with the embodiment shown in FIG. 9.

Other arrangements are also possible. For example, although the drive element 64' is shown a being clamped to a right end face of the housing 30' by the end cap 160, it can be mounted in a manner similar to that shown in FIG. 1. In particular, slots 58 (shown in FIGS. 1 and 2) can be formed at the right end of the housing 30' which would be adapted to receive tabs 70 (shown in FIG. 6) of the drive element 64.

In an alternate arrangement, the drive unit 12' could include a carrier 50 such as that shown in FIGS. 1 and 2. If a carrier were employed however, the support element (66 in FIG. 1) would not be mounted within the carrier.

Although the invention has been described with a certain degree of particularity, it should be understood that those skilled in the art can make various changes to it without departing from the spirit or scope of the invention as hereinafter claimed.

We claim:

1. A wire twisting tool, comprising:

(a) a pair of jaws for clamping wire to be twisted;

(b) means for locking said jaws in a wire clamping position;

(c) means for rotating said jaws while clamping the wires in order to twisting said wires together, said rotating means including:

(i) a drive mechanism including a housing slidably receiving a spiral drive shaft including means for imparting rotation to said housing upon relative axial movement between said shaft and said housing;

(ii) said housing including a pair of shaft engaging elements, one of said elements fixed to said housing and including structure engageable with said shaft;

(iii) another of said elements spaced from said first element and slidably receiving said shaft to maintain said shaft in predetermined alignment with respect to said housing:

(iv) mounting means mounting said other element such that relative axially movement between said other element and said housing is substantially inhibited while enabling relative axial movement between said shaft and said other element.

2. The wire twisting tool of claim 1 wherein at least one of said shaft engaging elements is formed from a metal stamping and is press fitted into said housing, said one element defining an aperture configured to substantially conform to a cross section of said drive shaft.

3. The wire twisting tool of claim 1 wherein the other of said shaft engaging elements is mounted for rotative movement relative to said housing.

4. The wire twisting tool of claim 1 wherein said other shaft engaging element is fixed to said housing.

5. The apparatus of claim 1 wherein:

(a) said other shaft engaging element forms a support for said shaft and said other element is mounted for rotative movement within said housing; and (b) said drive shaft is formed with a variable pitch such that said support element rotates to accommodate a change in pitch of said shaft as said shaft is pulled from said housing.

6. A wire twisting tool, comprising:

(a) a pair of jaws for clamping wires to be twisted;

(b) means for locking said jaws in a wire clamping position;

(c) a housing for at least partially enclosing a spiral drive shaft;

(d) a spin drive unit for imparting rotation to said jaws, said unit including:

(i) a carrier removably secured to said housing;

(ii) a pair of shaft engaging elements mounted in a spaced apart relationship within said carrier and operatively engaging said spiral shaft such that as said shaft is pulled through said carrier, rotation is imparted to said carrier.

7. The wire twisting tool of claim 6 where one of said shaft engaging elements is fixed to said carrier and the other of said shaft engaging elements is mounted for relative movement within said carrier.

8. The wire twisting tool of claim 6 wherein said spiral shaft includes multiple pitches and said relatively movable shaft engaging element moves within said carrier to accommodate a change in pitch as said shaft is pulled through said carrier.

9. The wire twisting tool of claim 6 wherein said shaft engaging elements each comprise a stamping defining an aperture that conforms substantially to a cross section of said spiral shaft.

10. The wire twisting tool of claim 7 wherein said fixed element includes element structure engageable with complemental structure formed in said carrier.

11. The wire twisting tool of claim 10 wherein said element structure comprises ears formed on said fixed element and said complemental structure comprises slots adapted to receive said ears.

12. The wire twisting tool of claim 6 further comprising a spring means acting between said elements.

13. The wire twisting tool of claim 8 wherein said relatively movable element rotates relative to said carrier to accommodate changes in pitch.

14. The wire twisting tool of claim 8 wherein said relatively movable element moves axially within said carrier to accommodate changes in pitch.

15. The wire twisting tool of claim 6 wherein at least one of said shaft engaging elements includes bearing means engageable with said shaft.

16. The wire twisting tool of claim 7 wherein said fixed element defines an aperture formed to be similar to a cross-section of said spiral drive shaft.

17. The wire twisting tool of claim 12 wherein said spring means applies a drag force to said drive shaft.

18. The wire twisting tool of claim 7 wherein an endface of said housing forms an abutment for said relatively movable element to limit its axial travel.

19. The wire twisting tool of claim 6 wherein said shaft engaging elements are similarly configured and are both press fitted into said carrier.

20. The wire twisting tool of claim 6 wherein said housing and carrier are threadedly engaged.

21. A wire twisting tool, comprising:

(a) a pair of jaws for clamping wires to be twisted;

(b) means for locking said jaws in a wire clamping position;

(c) means for rotating said jaws while clamping the wires in order to twist said wires together, said rotating means including:

(i) a drive mechanism including a housing slidably receiving a spiral drive shaft including means for imparting rotation to said housing upon relative axial movement between said shaft and said housing;

(ii) said housing including a pair of shaft engaging elements, one of said elements being removeably clamped to structure forming part of said housing whereby said element may be removed and replaced;

(iii) another of said elements operative to maintain said shaft in predetermined alignment with respect to said housing.

22. The apparatus of claim 21 wherein said other element is spaced from said first element and slidably receives said shaft.

23. The wire twisting tool of claim 21 wherein said other element is attached to said shaft and is slidable within said housing.

24. The wire twisting tool of claim 21 wherein said one element is removably clamped to said structure forming part of said housing by an end cap means.

25. The wire twisting tool of claim 24 wherein said end cap means is threadedly engageable with said housing structure.

26. A wire twisting tool, comprising:

(a) a pair of jaws for clamping wires to be twisted;

(b) means for locking said jaws in a wire clamping position;

(c) means for rotating said jaws while clamping the wires in order to twist said wires together, said rotating means including:

(i) a drive mechanism including a housing and a removeable carrier releasably attached to said housing slidably receiving a spiral drive shaft;

(ii) means for imparting rotation to said housing upon relative axial movement between said shaft and said carrier including a pair of shaft engaging elements supported by said removeable carrier, one of said elements being fixed to said carrier and including structure engageable with said shaft;

(iii) another of said elements operative to maintain said shaft in predetermined alignment with respect to said removable carrier.

* * * * *